US005356492A

United States Patent [19]

Miller

[11] Patent Number: 5,356,492

[45] Date of Patent: Oct. 18, 1994

[54] NON-TOXIC CORROSION RESISTANT CONVERSION PROCESS COATING FOR ALUMINUM AND ALUMINUM ALLOYS

[75] Inventor: Robert N. Miller, Acworth, Ga.

[73] Assignee: Locheed Corporation, Calabasas, Calif.

[21] Appl. No.: 56,169

[22] Filed: Apr. 30, 1993

[51] Int. Cl.[5] ..... C23C 22/56

[52] U.S. Cl. ..... 148/273; 148/275

[58] Field of Search ..... 148/273, 275

[56] References Cited

U.S. PATENT DOCUMENTS

| | | | |
|---|---|---|---|
| 4,610,732 | 3/1985 | Sasaki | 148/273 |
| 5,192,374 | 3/1993 | Kindler | 148/273 |
| 5,194,138 | 3/1993 | Mansfield | 148/273 |

*Primary Examiner*—Sam Silverberg

*Attorney, Agent, or Firm*—Eric R. Katz; John J. Sullivan

[57] ABSTRACT

A non-toxic corrosion resistant conversion coating process for aluminum and aluminum alloys which includes subjecting the aluminum to an aqueous solution containing hydrogen peroxide or cerous chloride, alone or in combination with strontium chloride. The corrosion resistance is improved by a subsequent treatment in an alkaline solution containing molybdate, nitrite and metasilicate ions. The corrosion resistant is further improved by treating the coated surface with an acholic solution containing glycidoxy(epoxy)polyfunctionalmethoxysilane, alone or in combination with phenyltrimethoxysilane. The coating thus produced is a mixture of oxides and hydroxides of cerium, strontium and aluminum. These oxides and hydroxides may also be intermixed with molybdate silicate and nitrite ions. In the most corrosion resistant form the mixture further includes a silane overcoat.

14 Claims, No Drawings

NON-TOXIC CORROSION RESISTANT CONVERSION PROCESS COATING FOR ALUMINUM AND ALUMINUM ALLOYS

TECHNICAL FIELD

This invention relates to conversion coatings for the corrosion protection of aluminum and aluminum alloys. More specifically, a process is proposed wherein a protective coating or film is produced on the surface of aluminum or aluminum alloys by a chemical reaction with the aluminum, which process does not include toxic elements such as chromates. The coating herein produced is particularly designed and adapted for use in military applications wherein stringent test requirements, as set forth in Military Specification, MIL-C-5541C, must be met.

BACKGROUND OF THE INVENTION

Applicant has heretofore filed on Sep. 3, 1991, an invention entitled "Non-Toxic Corrosion Resistant Conversion Coating for Aluminum and Aluminum Alloys and the Process for Making the Same", Ser. No. 754,136.

As discussed in that earlier application, conversion coatings are employed on metals, notably aluminum and aluminum alloys whereby the metal surface reacts with a solution to convert to a corrosion protective film. Often, but not always, this protective film serves as a primer which may be top-coated with a paint for appearance purposes and also to enhance corrosion resistance. Heretofore, conversion coatings have employed chromates where maximum corrosion protection is desired or required. The most widely used chromate treatment for aluminum is the chromate-containing Alodine 1200 process (Alodine 1200 is manufactured and sold by Amchem Products, Inc., Ambler, Pa.). The Alodine process, however, puts chromates into waste water which are either not permitted or are severely restricted by the Environmental Protection Agency of the United States Government. Illustrative of such chromate uses in protective coatings are the U.S. Pat. Nos. 4,146,410 to Reinhold and 4,541,304 to Batiuk and the prior art references cited therein.

Where efforts have been made to avoid the use of chromates in conversion coatings special treatments are required which in most cases are either objectionable and unacceptable or do not provide the required or desired degree of corrosion resistance. Illustrative of such non-chromate coatings are the following U.S. Pat. Nos. 3,672,821 issued to Schlussler and 3,964,936 issued to Das. Also and more closely related to the present invention is the Great Britain patent 2 195 338A issued to Sanchem, Inc. and Paper No. 197 from CORROSION 86, entitled "Cationic Film Forming Inhibitors for the Protection of 7025 Aluminum Alloy Against Corrosion in Aqueous Chloride Solution" by Arnott, Hinton and Ryan presented at the annual meeting of the National Association of Corrosion Engineers, Mar. 17–21, 1986.

The Sanchem patent proposes a non-toxic conversion coating process employing relatively high alkaline solutions (pH 7 to 14) and is limited to in-house or laboratory use because of the elevated temperatures (at least 150° F.) required. Moreover, the coating produced by Sanchem has limited corrosion inhibition, not acceptable in severe aqueous saline environments, notably MIL-C-5541C referred to above.

The Arnott et al. article recognizes the use of cerous chloride in lieu of a chromate to improve corrosion inhibition of aluminum. However, to be effective, exposure of the aluminum specimens to the cerous chloride is required for a prolonged time, on the order of 65 hours, which is unacceptable in production use. Moreover, the coated aluminum still fails to meet the corrosion protection requirements in severe aqueous saline environments.

Separately and apart from the foregoing, present day conversion coatings as illustrated by the above cited patents and publication, are readily wetted by moisture. It is well known that corrosion resistance of coatings is not as good as it could be if moisture were repelled, i.e., the coating were hydrophobic.

At the same time there is a problem in making surfaces hydrophobic. Paint topcoats will not adhere to surfaces which are highly hydrophobic, i.e., surfaces which have too low a surface energy. Surfaces readily wetted by water have energies greater than 65 dynes/cm. while surfaces such as polyethylene and teflon which have surface energies of approximately 25 dynes/cm. are not readily wetted by moisture or solvents. Consequently it is difficult to get adequate paint adherence on surfaces having low energy. However, it was demonstrated that the standard epoxy-polyamide paint (MIL-P-23377) used on Air Force and Navy aircraft will adhere well to surfaces having an energy at or above 40 dynes/cm.

In that earlier application a non-chromate chemical conversion coating process is described which involves a five minute treatment in a cerous chloride—potassium permanganate solution at room temperature and a subsequent 10 minute treatment in a hot sodium nitrite—sodium molybdate—sodium metasilicate solution.

Although this process produces a corrosion resistant coating on aluminum and aluminum alloys, it in some cases may not be economical for production. The cerous chloride—potassium permangante solution weakens over time and becomes unstable making it objectionable in cases where a lengthy shelf life is desired. A dark brown precipitate is gradually formed in the bath indicating undesirable chemical activity and a loss of effectiveness. Inasmuch as the cerous chloride is fairly expensive, this may make the process in some production situations too costly to operate. Also, the potassium permanganate solution is a deep purple color which might present waste disposal problems and objections from the Environmental Protection Agency of the U. S. Government.

The concentration of cerous chloride in the cerous chloride potassium permanganate used in the original process was 10 grams per 100 ml of water. The results of significant experiments have demonstrated this concentration can be reduced by a factor of 10. This greatly reduces not only the cost of operating and maintaining the bath but also increases the corrosion resistance of treated specimens. For example, a five minute immersion in a permanganate solution containing 10% cerous chloride produces 7075-T6 aluminum specimens with a corrosion rate of 2.02 mils/yr. Specimens treated in a solution containing only 1% cerous chloride have a corrosion rate of 0,165 mils/yr. The corrosion rates were determined by conducting potentiodynamic corrosion tests in aerated 0.35% NaCl solution. The improvement in corrosion resistance is probably due to the morphology of the mixture of cerous and aluminum oxides and hydroxides in the gold layer which is formed on the surface of the specimen. An added benefit is that the more dilute solution is more stable and will retain its activity longer than the solution which contains 10% cerous chloride.

A second major improvement in the formulation was effected following a reduction in the cerous chloride concentration permanganate. When a 7075-T6 aluminum specimen was immersed in a solution containing 50 milliliters (ml) of deionized water, 0.5 grams of cerous chloride and 5 ml of 30% hydrogen peroxide for 5 minutes at room temperature a conversion coating was obtained and the corrosion rate of the specimen was 0.43 mils/yr. Although this was not as low as the 0.165 mils/yr produced by the permanganate solution, the performance in immersion tests in 3.5% NaCl was much better. The specimens treated with the permanganate solution began to turn black after 5 days but the specimens treated with the hydrogen peroxide solution retained the original gold color.

The hydrogen peroxide solution eliminates the waste disposal problem inherent in the permanganate solution and is also more stable. After one week the hydrogen peroxide solution was reactivated by adding more hydrogen peroxide. An aluminum specimen treated in the reactivated solution had a corrosion rate of 0.43 mils/yr, the same as specimens treated with a fresh solution.

For maximum corrosion resistance specimens treated in the improved solution would still have to be immersed in a hot (200 degree F.) molybdate—nitrite—silicate solution for ten minutes. However, the use of the improved solution minimizes the problem of bath stability and also significantly reduces the cost of the process.

Corrosion resistance is further improved by an added layer or overcoat produced by treating the coated aluminum surface with an alcoholic solution containing glycidoxy(epoxy)polyfunctionalmethoxysilane alone or in combination with phenyltrimethoxysilane. The particular alcohol used in these solutions are, for example, ethyl, isopropyl or methyl which are known to be equally effective as solvents for the silanes.

The above and other objects and advantages of the present invention will become more apparent from the following detailed description included in the best mode for carrying out the invention.

BEST MODE FOR CARRYING OUT THE INVENTION

Generally, the present invention is practiced in the following sequence of operations. Initially, the aluminum or aluminum alloy is prepared for treatment in accordance with the invention by standard techniques of degreasing and deoxidizing known to and practiced routinely by persons skilled in the art. For example, the aluminum or aluminum alloy is degreased by putting it in a hot (about 140° F.) detergent solution; then rinsed thoroughly with water at ambient temperature; and finally deoxidized completely by manually abrading its surface with a carborundum pad or by immersion in a standard, commercially available deoxidizing solution and rinsed thoroughly with water at ambient temperature.

Having thus prepared the aluminum or aluminum alloy specimen, four basic solutions and their variations are prepared as follows:

Solution A comprises:
- 50 ml $H_2O$
- 5 ml $H_2O_2$ (35%)
- 0.5 g $CeCl_3$

Variation of Solution A:
- 50 ml $H_2O$
- 5 ml $H_2O_2$
- 0.3 g $CeCl_3$
- 0.2 g $SrCl_2$ Solution A and its variation are acidic and have pH values ranging from 3 to 5.

Solution B Comprises:
- 500 ml $H_2O$
- 5 g $Na_2MoO_4$
- 5 g $NaNO_2$
- 3 g $Na_2SiO_3$ Solution C Comprises:
- 90 ml Ethyl Alcohol (EtOH)
- 5 ml Phenyltrimethoxysilane (X1-6124, Dow Corning)
- 5 ml Glycidoxy(epoxy)polyfunctionalmethoxysilane (Z-6040, Dow Corning)

Solution D Comprises:
- 90 ml EtOH
- 10 ml Glycidoxy(epoxy)polyfunctionalmethoxysilane (Z-6040, Dow Corning)

In order to meet the requirements of MIL-C-5541C three of the above solutions must be employed. This is done in the following manner:

Step 1. The specimen is immersed in Solution A for about 10 minutes at room or ambient temperature and then thoroughly rinsed in water at ambient temperature.

Step 2. The specimen is then immersed in Solution B at about 200° F. for approximately 10 minutes and then thoroughly rinsed in water at ambient temperature.

Step 3. The specimen is then swabbed with Solution C or with Solution D and allowed to dry at ambient temperature.

Thus, a coating of multiple layers is produced on the surfaces of the specimen to give it maximum corrosion protection.

The reaction of Solution A with the surface of the aluminum or aluminum alloy produces a conversion coating comprised of a mixture of the oxides and hydroxides of cerium and aluminum. When using the variation of Solution A which includes strontium the conversion coating is comprised of a mixture of the oxides and hydroxides of cerium, aluminum and strontium.

The reaction of Solution B with the aluminum or aluminum alloy produces a coating comprised of a mixture of molybdate, silicate and nitrite ions intermixed with the oxides and hydroxides of aluminum.

The reaction of Solution B with the coating produced by Solution A produces a layer containing cerous molybdate, and cerous silicate mixed with the oxides and hydroxides of aluminum.

Solution C, when applied following the use of Solution A or B or the variation of Solution A as above, produces an additional surface layer containing a cross-linked silane structure resulting from the reaction between atmospheric moisture and the mixture of phenyltrimethoxysilane and glycidoxy(epoxy)polyfunctionalmethoxysilane.

Solution D, when applied following the use of Solution A or B or the variation of Solution A as above, produces an additional surface layer comprised of a cross-linked reaction product of atmospheric moisture and glycidoxy(epoxy)polyfunctionalmethoxysilane.

For less stringent requirements than those of MIL-C-5541C and for repairs to aluminum and aluminum alloy surfaces in the field, in Step 1 above, Solution A or its variation may be applied by swabbing and rinsing thoroughly after about 10 minutes and Step 2 as stated above may be omitted. Subsequent treatment of the specimen with Solution C or D will result in corrosion protection for approximately 176 hours of salt fog exposure, as opposed to 336 hours when three Solutions A, B and C or D are used.

The present invention may be further understood from the tests that were performed as described in the EXAMPLES below. In each case preliminary to the tests the aluminum or aluminum alloy specimen was prepared following standard practices as follows:

1. The specimen was degreased by being placed in a hot (about 140° F.) alkaline cleaner for 10–15 minutes and then rinsed thoroughly in water at room or ambient temperature.

2. The specimen was then deoxidized completely, i.e., in the case of small pieces, it was abraded with SCOTCHBRITE (tradename of a product manufactured and sold by 3M Inc., Minneapolis, Minnesota) and in the case of larger pieces, it was immersed in an acid chemical deoxidizer (Turco SMUTGO NC-B, which is a tradename for such a product manufactured and sold by Turco Products Division of Purex Corporation, Wilmington, Calif.) for about 15–25 minutes at room or ambient temperature, followed by a thorough rinse in water at room or ambient temperature.

The following EXAMPLES illustrate the effectiveness of the various treatments and combination of treatments in minimizing corrosion of aluminum alloys exposed to aqueous saline solution while also providing acceptable paint adhesion. The alloy used in the tests was 7075-T6 aluminum. This alloy contains 2% copper and is especially susceptible to corrosion in aqueous saline solutions or environments.

The test used to determine corrosion resistance was the potentiostatic polarization test.

Potentiostatic Polarization Test

The 7075-T6 aluminum specimens were ¾" in diameter and 1" long. They were wet-polished with 600 grit silicon carbide paper prior to being treated by the chemical conversion coating procedures. The corrosion resistances of the coatings were evaluated with a Princeton Applied Research Model 350 Corrosion Measurement Unit. In this test the specimen was immersed in 0.35% NaCl solution and functioned as an electrode. A carbon electrode was also immersed in the solution. The current flowing between the electrodes was plotted while a varying voltage (−1.0 to −0.5 volts) was applied between the electrodes. From the resulting Voltage vs Current plots it was possible to calculate the corrosion rate of the treated aluminum in the solution when no current was flowing in the circuit. The corrosion rate is expressed in mils per year.

It should be noted that the specimens and panels in each of the EXAMPLES below were thoroughly rinsed after treatment in each solution.

EXAMPLE I

A 7075-T6 aluminum potentiostatic specimen was immersed for 10 minutes in Solution A at room temperature. The corrosion rate in 0.35% NaCl solution was 0.23 mils/year.

Solution A contains a minimum concentration of cerous chloride (1%) and it utilizes hydrogen peroxide ($H_2O_2$) instead of potassium permanganate as the oxidizing agent. This eliminates a potential waste disposal problem because potassium permanganate produces a dark purple solution. Hydrogen peroxide is colorless and dissociates into water and oxygen.

Another major advantage of Solution A is that it is more stable than permanganate solutions and can be easily reactivated by adding hydrogen peroxide.

EXAMPLE II

This test illustrates the effectiveness of adding a silane as a final treatment to EXAMPLE I. A 7075-T6 aluminum potentiostatic specimen was immersed for 10 minutes in Solution A and then swabbed with a solution containing:

90 ml EtOH
5 ml X1-6124
5 ml Z-6040

The corrosion rate in 0.35% NaCl solution was thereby reduced from 0.23 to 0.15 mils/year.

EXAMPLE III

A 7075-T6 aluminum potentiostatic specimen was immersed for 10 minutes in Solution B at 200° F. The corrosion rate in 0.35% NaCl solution was 0.27 mils/-year.

EXAMPLE IV

A 7075-T6 aluminum potentiostatic specimen was immersed for 10 minutes in Solution A at room temperature. It was then immersed for 15 minutes in Solution B at 200° F. The corrosion rate in 0.35% NaCl solution was 0.11 mils/year.

The durability of this coating seems to be due to a chemical reaction between the coating produced by Step 1 and the subsequent reaction thereon of Solution B as used in Step 2. The solution used in Step 1, namely Solution A, is acidic and has a pH of 3.0. This creates an acidic conversion layer on the surface of the test specimens. Solution B used in Step 2 is strongly alkaline with a pH of 11.61. Thus, when the specimen with the acidic coating is immersed in the alkaline solution at the beginning of Step 2 there is a neutralization reaction between the acidic and alkaline components. Many small bubbles are emitted for about 30 seconds and one of the products of the reaction is a corrosion resistant layer on the surface of the aluminum.

EXAMPLE V

A 7075-T6 potentiostatic aluminum specimen was immersed for 10 minutes in Solution B at 200° F. It was then immersed for 5 minutes in Solution A at room temperature. The corrosion rate in 0.35% NaCl solution was 2.75 mils/year.

EXAMPLE VI

A 7075-T6 aluminum specimen was immersed in Solution A at room temperature for 10 minutes and in Solution C for 30 seconds. After a 24-hour time period to allow the silane in Solution D to cure by reacting with the moisture in the atmosphere the corrosion rate in 0.35% NaCl was 0.36 mils/year.

EXAMPLE VII

A 7075-T6 aluminum specimen was immersed in Solution A at room temperature for 10 minutes, in Solution B at 200 degrees F. for 10 minutes and in Solution C for 30 seconds. After 24 hours the corrosion rate in 0.35% NaCl was 0.01 mils/year.

EXAMPLE VIII

A 7075-T6 aluminum specimen was immersed in Solution A at room temperature for 10 minutes, in Solution B at 200 degrees F. for 10 minutes and in solution D for 30 seconds. After 24 hours to allow the silane in Solution D to cure the corrosion rate in 0.35% NaCl was 0.0087 mils/year.

EXAMPLE IX

A 7075-T6 aluminum specimen was immersed in the variation of Solution A at room temperature for 10 minutes. The corrosion rate in 0.35% NaCl was 2.42 mils/year.

EXAMPLE X

A 7075-T6 aluminum specimen was immersed in the variation of Solution A at room temperature for 10 minutes and in Solution B at 200 degrees F. for 10 minutes. The corrosion rate in 0.35% NaCl was 0.04 mils/-year.

EXAMPLE XI

A 7075-T6 aluminum specimen was immersed in the variation of Solution A at room temperature for 10 minutes and in Solution C for 30 seconds. After 24 hours the corrosion rate in 0.35% NaCl was 0.23 mils/-year.

EXAMPLE XII

A 7075-T6 aluminum specimen was immersed in the variation of Solution A at room temperature for 10 minutes and in Solution D for 30 seconds. After 24 hours the corrosion rate in 0.35% NACl was 1.04 mils/-year.

EXAMPLE XIII

A 7075-T6 aluminum specimen was immersed in the variation of Solution A at room temperature for 10 minutes, in Solution B at 200 degrees F. for 10 minutes and in Solution C for 30 seconds. After 24 hours the corrosion rate in 0.35% NaCl was 0.13 mils/year.

EXAMPLE XIV

A 7075-T6 aluminum specimen was immersed in variation of Solution A at room temperature for 10 minutes, in Solution B at 200 degrees F. for 10 minutes and in Solution D for 30 seconds. After 24 hours the corrosion rate in 0.35% NaCl was 0.01 mils/year.

EXAMPLE XV

A 7075-T6 aluminum specimen was immersed in Solution B at 200 degrees F. for 10 minutes and in the variation of Solution A at room temperature for 10 minutes. The corrosion rate in 0.35% NaCl was 0.35 mils/year.

EXAMPLE XVI

A 7075-T6 aluminum potentiostatic specimen was immersed for 10 minutes in Solution B at 200 degrees F. and in Solution A for 10 minutes at room temperature. The corrosion rate in 0.35% NaCl was 2.75 mils/year.

The net result of each of the preceding processes is a chemical conversion coating which gives dual protection to aluminum. First, it forms a barrier layer which protects it from the environment and, second, if the barrier layer is penetrated in spots it prevents exposed metal from corroding by sacrificially dissolving and making the exposed spots cathodic.

While the invention has been hereinabove described with reference to preferred embodiments thereof, it will be understood by those skilled in the art that various alterations may be made therein without departing from the spirit and scope of the invention as covered by the appended claims.

I claim:

1. A process for producing a corrosion resistant chemical conversion coating on aluminum and aluminum alloys comprising subjecting a cleaned, degreased and deoxidized aluminum to an aqueous solution containing cerous chloride and hydrogen peroxide wherein an acidic condition is created by the hydrolysis of the cerous chloride.

2. The process of claim 1 wherein the aqueous solution created as aforesaid further contains strontium chloride.

3. The process of claim 1 followed by a thorough rinsing of the treated aluminum aforesaid and then subjecting said treated aluminum to a solution containing ethyl alcohol, phenyltrimethoxysilane and glycidoxy(epoxy)polyfunctionalmethoxysilane whereby the coating thus produced on said aluminum combines water repellency with good paint adherence.

4. The process of claim 1 followed by a thorough rinsing of the treated aluminum aforesaid and then subjecting said treated aluminum to a solution containing ethyl alcohol and glycidoxy(epoxy)polyfunctionalmethoxysilane whereby the coating thus produced on said aluminum combines water repellency with good paint adherence.

5. The process of claim 1 followed by a thorough rinsing of the treated aluminum aforesaid and then subjecting said treated aluminum to a solution containing sodium molybdate, sodium nitrite and sodium metasilicate at about 200° F.

6. The process of claim 2 followed by a thorough rinsing of the treated aluminum aforesaid and then subjecting said treated aluminum to a solution containing ethyl alcohol, phenyltrimethoxysilane and glycidoxy(epoxy)polyfunctionalmethoxysilane whereby the coating thus produced on said aluminum combines water repellency with good paint adherence.

7. The process of claim 2 followed by a thorough rinsing of the treated aluminum aforesaid and then subjecting said treated aluminum to a solution containing ethyl alcohol and glycidoxy(epoxy)polyfunctionalmethoxysilane whereby the coating thus produced on said aluminum combines water repellency with good paint adherence.

8. The process of claim 2 followed by a thorough rinsing of said aluminum and then subjecting said aluminum to a solution containing sodium molybdate, sodium nitrite and sodium metasilicate at about 200° F.

9. The process of claim 1 followed by a thorough rinsing of said aluminum, then subjecting said aluminum to an aqueous solution containing sodium molybdate, sodium nitrite and sodium metasilicate and finally after a thorough rinsing said aluminum is subjected to a solution containing alcohol, phenyltrimethoxysilane and glycidoxy(epoxy)polyfunctionalmethoxysilane.

10. The process of claim 1 followed by a thorough rinsing of said aluminum, then subjecting said aluminum to an aqueous solution containing sodium molybdate, sodium nitrite and sodium metasilicate and finally after thoroughly rinsing said aluminum is subjected to a solution containing alcohol and glycidoxy(epoxy)polyfunctionalmethoxysilane.

11. The process of claim 2 followed by a thorough rinsing of said aluminum, then subjecting said aluminum to an aqueous solution containing sodium molybdate, sodium nitrite and sodium metasilicate at about 200° F. and finally after a thorough rinsing said aluminum is subjected to a solution containing alcohol, phenytrimethoxysilane and glycidoxy(epoxy)polyfunctionalmethoxysilane.

12. The process of claim 2 followed by a thorough rinsing of said aluminum, then subjecting said aluminum to an aqueous solution containing sodium molybdate, solidum nitrite and sodium metasilicate at about 200° F. and finally after thoroughly rinsing said aluminum is subjected to a solution containing alcohol and glycidoxy(epoxy)polyfunctionalmethoxysilane.

13. A process for producing a corrosion resistant chemical conversion coating on aluminum and aluminum alloys comprising subjecting a cleaned and deoxidized aluminum surface to an aqueous solution containing sodium molybdate, sodium nitrite and sodium metasilicate at about 200 degrees F. and then subjecting said treated aluminum to an aqueous solution containing cerous chloride and hydrogen peroxide.

14. The process of claim 13 wherein the solution which contains cerous chloride and hydrogen peroxide also contains strontium chloride.

* * * * *